United States Patent [19]

De Monti

[11] 4,244,603

[45] Jan. 13, 1981

[54] BOOK, MORE PARTICULARLY POCKET DICTIONARY

[75] Inventor: Laura De Monti, Lugano, Switzerland

[73] Assignee: Prototypon Establishment, Steinort, Liechtenstein

[21] Appl. No.: 37,394

[22] Filed: May 9, 1979

[30] Foreign Application Priority Data

May 9, 1978 [CH] Switzerland ..... 5031/78

[51] Int. Cl.[3] ..... B42D 1/06; B42D 3/00

[52] U.S. Cl. ..... 281/15 R; 281/19 R; 281/29; 402/3; 402/80 P

[58] Field of Search ..... 281/1, 3, 4, 15 R, 19 R, 281/20, 29, 30; 402/3, 80 P

[56] References Cited

U.S. PATENT DOCUMENTS

| | | | |
|---|---|---|---|
| 871,610 | 11/1907 | Nash | 281/20 |
| 1,070,957 | 8/1913 | Hanby | 281/38 |
| 2,290,266 | 7/1942 | Bechtold | 281/38 X |
| 2,572,703 | 10/1951 | Dennis | 281/1 |
| 3,087,498 | 4/1963 | Vogel | 402/80 P |
| 3,140,883 | 7/1964 | Anthony | 281/42 X |
| 3,740,128 | 6/1973 | Adler | 281/15 R X |

FOREIGN PATENT DOCUMENTS

| | | | |
|---|---|---|---|
| 489237 | 7/1938 | United Kingdom | 281/15 R |
| 570789 | 7/1945 | United Kingdom | 281/15 R |
| 1062012 | 3/1967 | United Kingdom | 281/15 R |
| 1291866 | 10/1972 | United Kingdom | 281/15 R |

*Primary Examiner*—Paul A. Bell

*Attorney, Agent, or Firm*—Scully, Scott, Murphy & Presser

[57] ABSTRACT

Book comprising uncreasable and water-proof cards (6) of a thickness remaining constant in time, these cards being produced from plastics, the text thereon being printed by typographic or offset or other process in a manner known per se. The thickness of the cards is comprised between 0.20 and 0.26 mm and polyvinyl chlorides or polystyrene can be used as plastics. Each card has a configuration comprising converging edges (9, 10) at one end provided with a circular cut-out (7) for a prin connecting all the cards (6).

6 Claims, 19 Drawing Figures

BOOK, MORE PARTICULARLY POCKET DICTIONARY

The present invention relates to printed works and more particularly to books of small sized termed pocket size such as e.g. dictionaries or vocabularies.

The present development of the tourist trade and, generally speaking, the growth of international relations lead to a more and more urgent need of pocket dictionaries or vocabularies the size of which, although already reduced, is if possible of still smaller dimensions, in order that they may be easily and rapidly consulted.

In order to comply with this trend one has proceeded from the conventional small size dictionaries, with pages bound together in a known manner, to dictionaries made up from an assembly of paper or cardboard from a fibrous material, e.g. cellulose, cards of slips laid one on the other, each card being radially rotatable on a pin led through a circular cutout provided at one end of the card, the assembly of these cards being locked in adequate manner on this pin.

It has, however, been noted that in practice this kind of book comprised of radially rotatable cards is not free from disadvantages which jeopardize its practical use and length of service. It has indeed been noted that the cards made up from paper or cardboard from fibrous material, e.g. cellulose, are easily spoiled by handling and by exposure to atmospheric conditions, particularly to rain. Under specific conditions of use this proves quite unavoidable because the crumpling and the distortions resulting from the moisture absorbed by the cards affect in some manner or other their thickness as, being made up from a fibrous material, they will impair their sliding over one another. This disadvantage is the more important as the cards are obviously of limited resistance and, consequently, more liable to tear particularly around the cut-out provided for the pin, the most vulnerable point of the assembly, but also in other points of the card. Obviously, immediate exposure to water in a general manner and, consequently the impregnation of the card seriously affect the latter rendering the text it bears quite illegible.

In any case, the limited tensile strength of each card favors increasing the thickness thereof, with unfavorable consequences for the bulk characteristics of the pocket dictionary.

The cut-out provided for the passage of the pin curtails to a fairly considerable extent the area available for printing, particularly when taking account of the circumstance that a large margin has to be provided around this cut-out in order to offset the limited tensile strength of the material used up to the present.

The object of the present invention is to provide a book, made up from cards connected at one end thereof by a pin and which is free of the said disadvantages. This object is fulfilled according to the invention due to the circumference that the cards are uncreasable and waterproof as well as of uniform thickness which remains the same at all times, these cards being produced from plastics whereon the text is printed by typographic or offset process in a manner known per se.

The thickness of the cards should not be less than 0.10 mm and preferably be comprised between 0.20 mm and 0.26 mm.

As plastics may be used polyvinyl chlorides or polystyrene.

The use of plastics permits the production of uncreasable and waterproof cards, resulting in their dimensions remaining practically perfectly stable at all times, particularly as regards the thickness of the cards. The latter benefit moreover of a high tensile strength as well as of an improvement of their ability to slide over one another. In addition it is possible to achieve thinner cards which, according to the invention, reduces the bulkiness of the cards assembly by comparison with cards made up from paper or cardboard from a fibrous material used up to the present.

The excellent mechanical characteristics of each plastics card afford advantageously the possibility to give the actual card a configuration with converging edges (if need be curved at least in part) at the end provided with the circular cut-out for the pin, so that a card rotating even by only a slight angle with reference to the following card shall overlap the latter as little as possible. Thus the area available for printing will be increased and, consequently, also that for reading each card, without prejudice to the tensile strength thereof because of its configuration.

Another extension of the readable area is achieved by providing the circular cut-out, either as a whole or in part, in the zone where the card edges converge, in such a manner that the corresponding margin shall be of minimum width at the most equal to three quarters of the diameter of the actual cut-out. In other words, the circular cut-out is provided in a location very close to the card end, without, however, the narrow margin thereof being subject to fractures during the use of the article thanks to the excellent mechanical characteristics of each card.

Other details and features of the invention will become apparent from the description hereinafter given by way of non limiting example with reference to the accompanying drawings.

Figure 1:
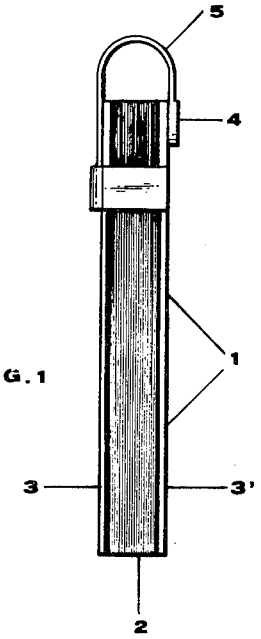
FIG. 1 shows a side elevation of the pocket dictionary with accessories.
Figure 3:
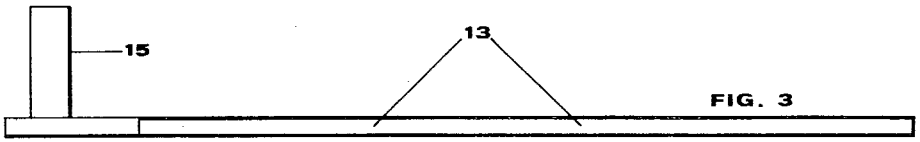
FIG. 3 shows a side elevation of a bottom cover.

As can be noted from FIG. 1, the dictionary 1 is comprised of an assembly 2 of uncreaseable plastics cards, located between two covers 3 and 3' likewise of plastics, the assembly of cards and covers being held together by a pin 4. A clip shaped locking device 5, fashioned into a ring when it acts on the cards assembly is also combined with the pin.

Figure 2:
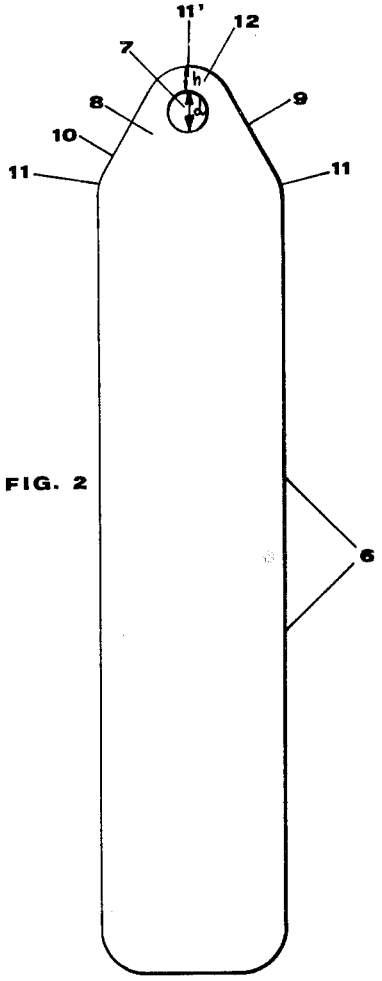
FIG. 2 shows a plane view seen from above of a card.
Figure 19:
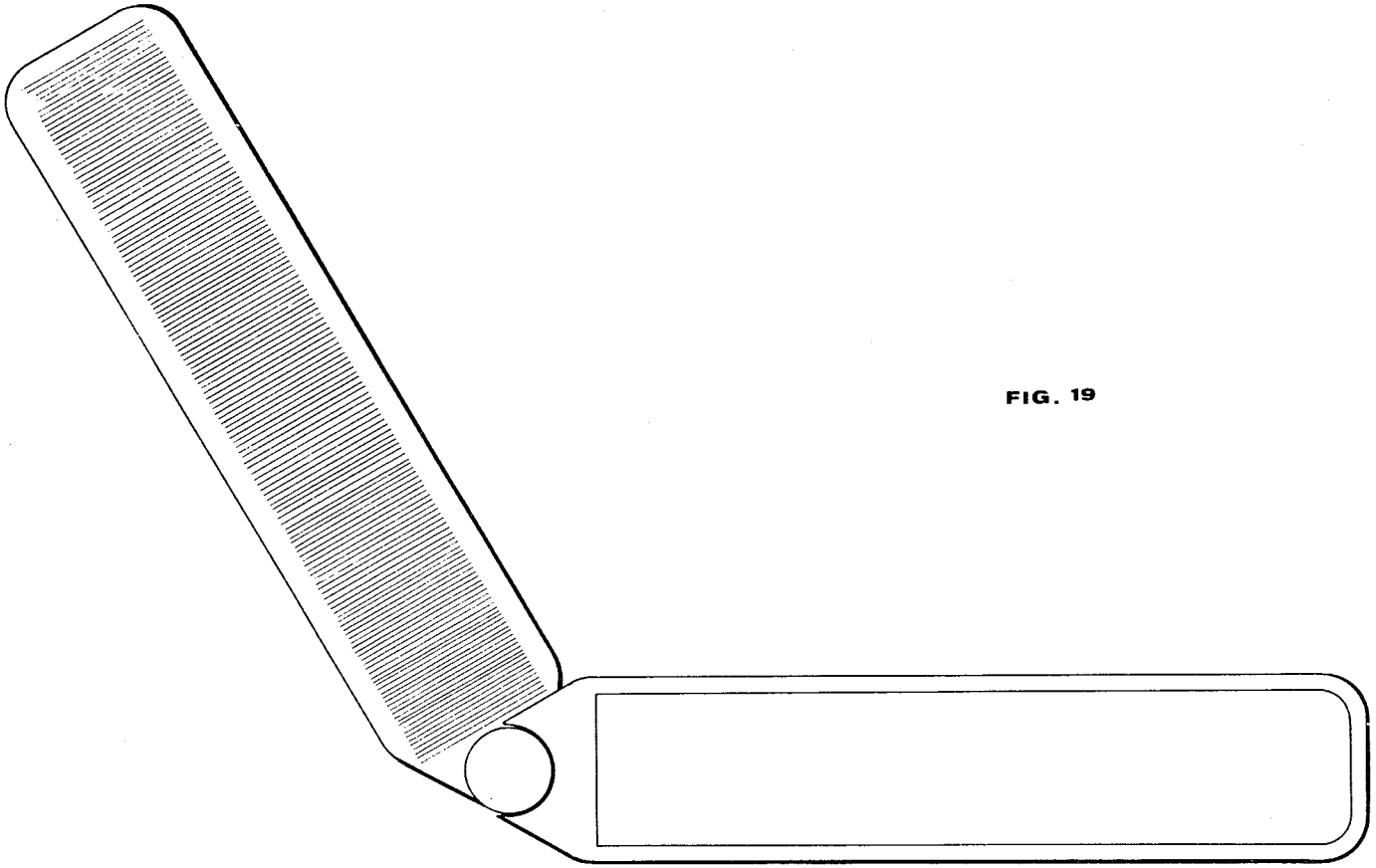
FIG. 19 shows the dictionary in the open position for consultation, the first card having been rotated through 120° with reference to the remaining cards.

The cards are all identical with one another. As may be seen in FIG. 2, each card 6 comprises a circular cut-out 7 for the pin and is provided at its end 8 relating to this cut-out with converging side edges 9 and 10, with slightly curved side connections 11 and a median one 11'. It is preferable that in the area 8 located between the converging edges 9 and 10 the cut-out 7 be located in a position sufficiently close to the end 11" in order to determine a margin 12 having a width h not exceeding $\frac{3}{4}$ of the diameter d of the cut-out. These conditions, i.e. the convergency of the edges 9 and 10 and the location of the cut-out 7 are of particular advantage for achieving a maximum reading area for each card. This advantage is clearly evidenced by FIG. 19 showing the dictionary in the open position, the first card having been rotated in order to permit reading the second card. Each card can be printed either on a single face or on both its faces.

If required the plastics sheet can be prepared for printing by means of a well known technology. After printing, the card can be provided with a thin protective coating of transparent synthetic resin applied according to also well-known processes. Consequently, the entries printed on the plastics card protected in this manner remain absolutely indelible, not only because of the presence of the protective layer, but also because, where this layer is absent, i.e. on the edge, the actual characteristics of the plastics used prevent the impregnation of water which damages the wording of the cards used up to the present.

The dictionary according to the invention can, as hereinbefore mentioned, be provided with two covers on the outside made from plastics, a top cover and a bottom cover, this distinction resulting, as described in greater detail below, from the different function of each cover in relation to the pin, rather than from its actual position, because, with the cards printed on both faces, no distinction is made between the top and bottom portions of the dictionary.

FIGS. 3 through 7 relate to the bottom cover. As will be noted on these Figures, the bottom cover 13, seen from above in FIG. 4, has the same dimensions and configuration as the card 6, from which it evidently differs by a greater thickness.

Figure 6:
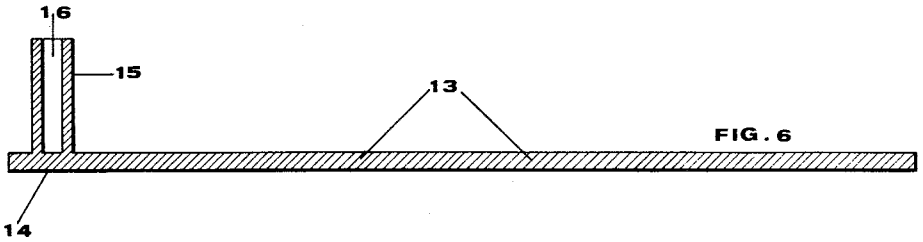
FIG. 6 shows a longitudinal section of this bottom cover along the axis of symmetry A—A of FIG. 4.
Figure 4:
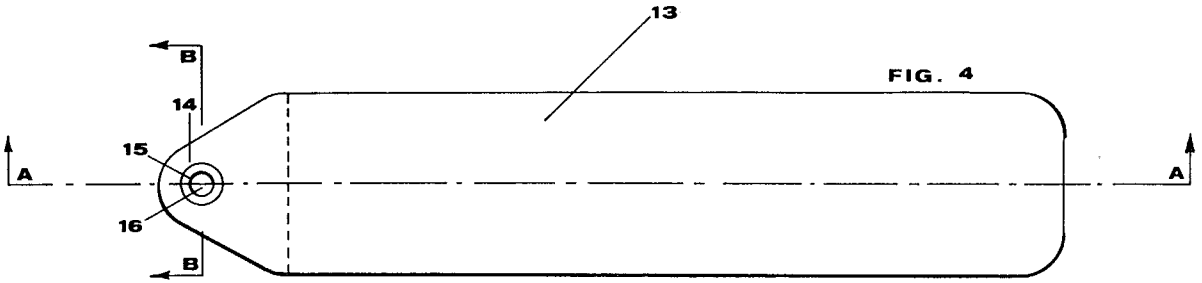
FIG. 4 shows a plane view seen from above of this bottom cover.
Figure 5:
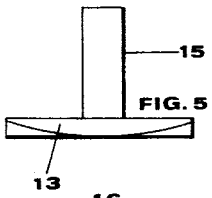
FIG. 5 shows a front elevation of this bottom cover.
Figure 7:
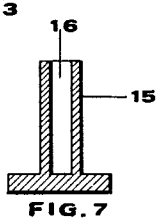
FIG. 7 shows a cross-sectional view of the bottom cover along the line B—B of FIG. 4.
Figure 8:
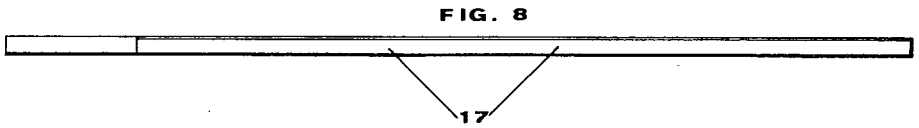
FIG. 8 shows a side elevation of a top cover.
Figure 11:
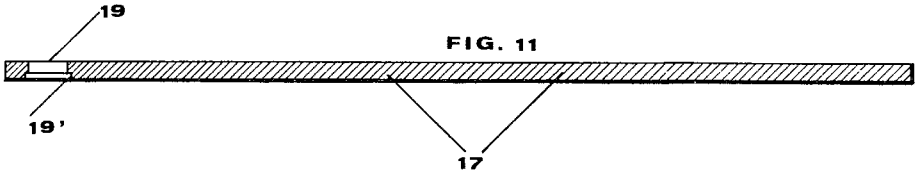
FIG. 11 shows a longitudinal section along the axis of symmetry C—C of FIG. 9.
Figure 9:
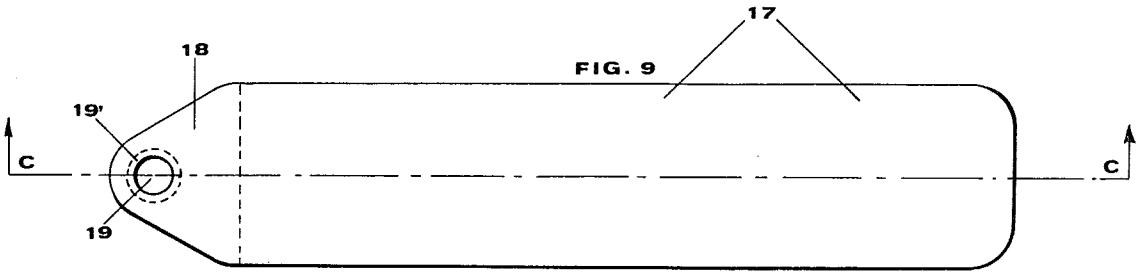
FIG. 9 shows a plane view seen from above of this top cover.
Figure 10:
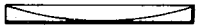
FIG. 10 shows a front elevation of this top cover.

With reference to the circular cut-out 7 of the card 6, the cover 13 comprises in its end portion 14 a small cylindrical hollow body 15, perpendicular to and integral with the bottom cover as may be noted from FIG. 6. This cylindrical body acts as a pin for stapling the cards 6.

The cover 13 may be produced from transparent plastics with optical properties known per se, enabling it to fullfil the function of an enlarging lens for reading the underlying cards. With this end in view, the cross-section of cover 13 comprises, as may be noted in FIG. 5, an externally convex configuration.

As plastics with optical characteristics it is possible to use acrylic resins, polycarbonates and similar materials.

FIGS. 8 through 11 relate to the top cover 17. This cover is evidently of the same configuration and dimensions as the card 6, while its thickness is higher than that of the card 6.

In its end portion 18, cover 17 comprises a circular cut-out 19 designed to take up the cylindrical hollow body 15 of the bottom cover 13, which, as described in greater detail hereinafter, holds together the assembly made up from the cards and the two covers.

The cover 17 may also be produced from transparent plastics with enlarging optical properties, thus also fullfilling the function of an enlarging lens for reading the cards. With this end in view, the cross-section of cover 17 also comprises an externally convex configuration as may be noted in FIG. 10.

Figure 13:
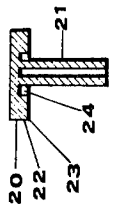
FIG. 13 shows an axial section of the element depicted in FIG. 12.
Figure 12:
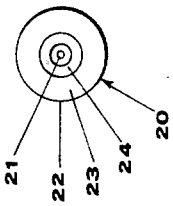
FIG. 12 shows a plane view seen from above of the side of the corresponding stem of the supplementary pin head element.
Figure 14:
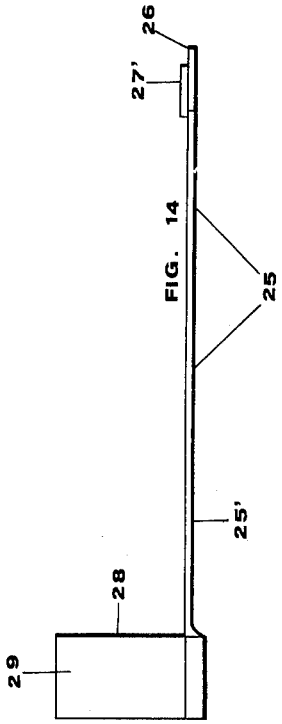
FIG. 14 shows a side elevation of a locking device in extended position.
Figure 17:
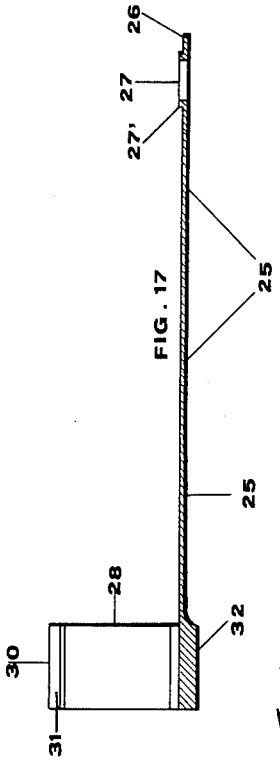
FIG. 17 shows a longitudinal section along the axis of symmetry D—D of FIG. 15.
Figure 15:
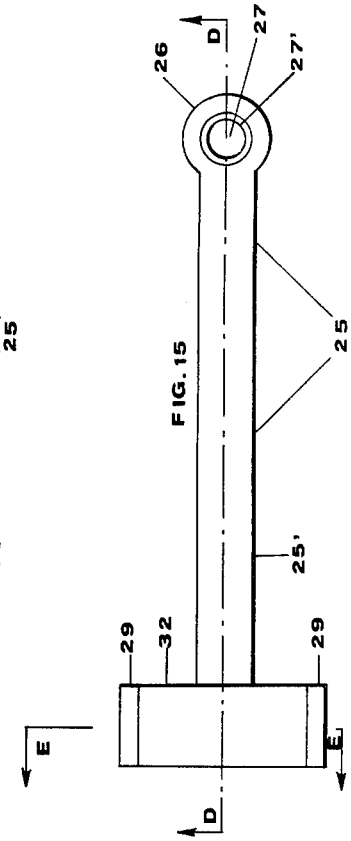
FIG. 15 shows a plane view seen from above of the locking device depicted in FIG. 14.
Figure 16:
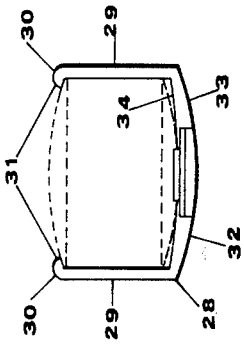
FIG. 16 shows a front elevation of the locking device.

As may be noted in FIGS. 12 and 13 there has been provided according to the invention an element 20, comprising a head made from plastics, designed to be inserted in the cavity 16 of the cylindrical body 15, after the latter shall have been threaded in the circular cut-out 7 of the cards 6 and in the hole 19 of the cover 17. This element 20 comprises a cylindrical stem 21 which can be hollow and a circular head 22 integral with the stem. On its face directed towards the stem, the head 22 comprises a peripheric circular shoulder 23 of such dimensions that after threading this element 20 into the hole 16 of the cylindrical body 15 of the cover 13, the free end of this cylindrical body 15 shall be fitted inside the circular recess 24 resulting from the presence of this circular shoulder 23. Evidently, the circumstance that the outside diameter of stem 21 is equal or slightly superior to the diameter of the hole 16 of the cylindrical body 15, concurs to achieving a perfect locking of the components.

The element provided with this head is for preference produced in the same plastics as the covers.

The stable positioning of the free end of the cylindrical body 15 in the circular cavity 24 of the element 20 prevents the top cover 17 and the cards 6 most adjacent thereto from being held back, rather than by the cylindrical body 15, by the stem 21 threaded therein, stem which, being of a smaller diameter than that of the cut-out 19 of the cover 17 and of the cut-outs 7 of the cards 6, could result in an undesirable clearance of this cover and these cards.

If desired, the dictionary can be provided with a locking element for the assembly of the covers and cards, locking element which is also held by the pin 15 in ultimate position before inserting the element 20 into the actual pin.

Figure 18:
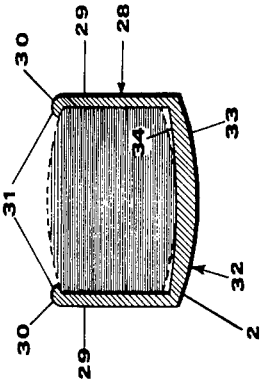
FIG. 18 shows a cross-sectional view of the locking device along the line E—E of FIG. 15, when all the cards together with the covers are in the rest position.

The locking element is produced from plastics with resilient characteristics, such as e.g. polyvinyl chlorides or a polycarbonate and, as may be noted in FIGS. 14 through 18 where it bears the reference number 25, this locking element comprises a strip 25' provided at one end with a circular enlargement 26 having a cut-out 27 designed to be also threaded by the pin 15, while this locking element comprises at the other end a housing 28 with a base 32 and two clamping arms 29 each of which is provided on its free horizontal rim 30 with an inwards directed shoulder 31. The sectional view of the base 32 of the housing comprises on its outside face 33 an outward convex configuration of shorter radius than that of the hollow configuration of its inside face 34. As a result, because of the resilient characteristics of the plastics used, the locking device 25, also connected to the pin 15 is folded back in such a manner that the two arms 29 clamp the assembly comprised of the covers and the cards, holding them resiliently fast because of the presence of their internal holding shoulder 31. FIG. 18 is a clear cross-sectional view of the assembly of the covers and cards held fast at the end of the housing 28 of the device 25, while on FIG. 1 may be noted how this locking device, bearing the reference numeral 5 and set in working position is of annular shape for holding the dictionary in hand in the closed condition.

In order to prevent any clearance of the locking device 25 with reference to the pin 15, the circular cut-out 19 of the cover 17 comprises on its outer face a slight cylindrical enlargement 19' which acts as a seat for the projecting edge 27' of the cut-out 2 of the locking device, thus ensuring the stability of the fastening of this device.

FIG. 19 illustrates the dictionary with a card rotated through 120° with reference to the other cards, in order to evidence the advantage afforded by the configuration with converging edges and the distinctly outermost location of the cut-out provided in the cards, in order to enlarge as far as possible the printable area and, consequently, readable on each card.

I claim:

1. A printed pocket dictionary constructed of an assembly of superposed elongated cards printed on both sides and two conforming external covers, each card and cover radially rotating in its respective plane about a pin threaded through a circular cut-out provided at an end of each of the cards and covers on their axial line, and each card and cover remaining partially in contact with adjacent card or cards, characterized in that:

(a) each card is formed of a slidable synthetic resin of the group comprising polyvinylchloride and polystyrene, has at said end, wherein the circular cut-out is provided for the pin, linear edges converging to form a curved apex, and the circular cut-out for the pin is located entirely in the zone with said converging edges such that the minimum width of the margin around said cut-out is at most equal to three quarters of the diameter of said cut-out; and (b) the thickness of each card is at least 0.10 mm.

2. A printed pocket dictionary as claimed in claim 1, wherein the thickness of each card is between 0.20 mm and 0.26 mm.

3. A printed pocket dictionary as claimed in claim 1, wherein the covers are transparent, characterized by said covers being formed of a synthetic resin of the group comprising acrylic resins and polycarbonates, and are shaped as enlarging lens to facilitate reading of the cards.

4. A printed pocket dictionary as claimed in claim 1, characterized in that one cover is provided with a small hollow cylindrical body, perpendicular to the plane of the cover and formed integral therewith, said cylindrical body forming a pin for the assembly of cards and the other cover, and wherein a supplementary element comprised of a head and a stem is combined with said pin, the stem being inserted in the hollow of the cylindrical pin body such that the free edge of the cylindrical body enters a circular recess in the lower portion of the head and achieved by means of a circular peripheric shoulder thereon parallel to the stem.

5. A printed pocket dictionary as claimed in claim 1, characterized in that it has a locking device comprised of a plastics strip connected on one side to the pin and provided on the other side with a clamping housing to resiliently clamp the assembly of cards and covers in a folded position, holding it securely by means of a shoulder directed inwards of the housing and provided on each one of the clamping arms.

6. A printed pocket dictionary as claimed in claim 5, characterized in that the locking device, with its clamping housing, has an annular shape.

* * * * *